United States Patent [19]

Silvestri

[11] Patent Number: 4,941,659

[45] Date of Patent: Jul. 17, 1990

[54] AQUATIC EXERCISER

[76] Inventor: Claudio Silvestri, 2825 Islington Avenue, Suite 410, Weston, Ontario, Canada, M9L 2K1

[21] Appl. No.: 304,246

[22] Filed: Jan. 31, 1989

[51] Int. Cl.[5] ..... A63B 1/00

[52] U.S. Cl. ..... 272/62; 272/71; 272/112; 272/143; 4/496; 4/511

[58] Field of Search ..... 272/62, 63, 65, 71, 272/112, 109, 900, 1 B; 4/494, 496, 511; D21/191, 198, 236; D25/2, 41; 211/105.1, 123, 86, 32; D12/317

[56] References Cited

U.S. PATENT DOCUMENTS

| | | | |
|---|---|---|---|
| D. 202,546 | 10/1965 | French | D21/236 |
| 2,886,315 | 5/1959 | Marshall | 272/1 B |
| 2,960,335 | 11/1960 | Shuttleworth | 272/62 X |
| 3,065,820 | 11/1962 | Prizler et al. | 4/496 X |
| 3,795,397 | 3/1974 | Wilson | 272/66 |
| 3,857,561 | 12/1974 | Cecchettini et al. | 272/63 X |
| 4,822,031 | 4/1989 | Olschewski | 272/62 |
| 4,838,545 | 6/1989 | Wilson | 272/71 X |
| 4,875,673 | 10/1989 | Erickson | 272/63 |

FOREIGN PATENT DOCUMENTS

| | | | |
|---|---|---|---|
| 3039519 | 5/1982 | Fed. Rep. of Germany | 272/62 |

*Primary Examiner*—Richard J. Apley
*Assistant Examiner*—David F. Crosby

[57] ABSTRACT

The present invention relates to an aquatic exerciser or rehabilitation equipment and, particularly, to an exerciser mounted for positioning a user engaging component in a cantilevered configuration over the edge of a swimming pool or other water body. The exerciser suspends user engaging members over the water and allows the user to carry out various exercises within the pool. Typically, the exercises include body lifting exercises and in contrast to conventional body lifting exercises carried out outside the water, the force required by the user increases in proportion to the amount of his body that is above the water level. In other circumstances the difficulty may be increased by carrying out certain movements within the water at higher speeds with the water providing a drag force as an increasing function of the speed. Thus, the user can either increase or decrease the difficulty of the exercise easily.

9 Claims, 3 Drawing Sheets

AQUATIC EXERCISER

FIELD OF THE INVENTION

The present invention relates to exercise equipment and, in particular, to exercise or rehabilitation equipment adapted for use by a user in water with the exercise equipment supported immediately adjacent the water.

BACKGROUND OF THE INVENTION

Various exercise equipment are known for use in dry land applications, however, exercising within a swimming pool or other water body have generally been confined to typical swimming exercises such as lengths, flutter kicks, as but some examples. Recently, water aerobic programs have been introduced. It is recognized that swimming exercises and particularly swimmers develop muscle strength throughout their body and swimming is considered an excellent activity for developing muscles as well as merely obtaining better conditioning.

SUMMARY OF THE INVENTION

The present invention allows swimmers to carry out traditional exercises such as leg raises, chin-ups, pull-ups, as but some examples in water, which exercises require the lifting of the person's body weight or a portion of his body weight in carrying out the exercise. This device allows the exercises to be carried out within a pool or other water body such that the user may take advantage of the buoyancy force of the water to progressively increase or decrease the strength required to partially carry out the exercise. It is also possible, depending upon the exercise, to vary the difficulty by varying the speed of the exercise whereby water drag is increased.

The apparatus of the present invention comprises a base unit adapted to be secured adjacent the edge of a swimming pool, for example, in combination with an extension means which extends out over the edge of the swimming pool. A user engaging member is secured to the extension means at a position over the pool and the user may engage the user engaging member to carry out various exercises.

In a preferred embodiment of the invention, the user engaging portion is selectively removable from the extension means whereby different configured user engaging members can be inserted for carrying out different exercises.

In a further preferred embodiment of the invention, the extension means is releasable, leaving only the mounting member adjacent the water.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 2:
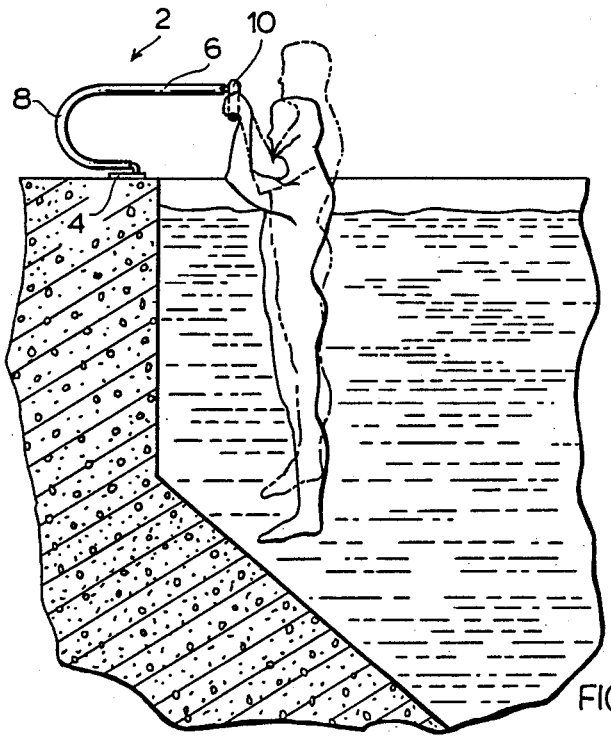
FIG. 2 is an elevational view showing the aquatic exerciser secured to a pool with a user carrying out various exercises.

The aquatic exerciser 2, generally shown throughout the drawings, comprises a base or mounting member 4 secured adjacent the edge of a swimming pool 14, with this base or mounting member cooperating with an extension member 6 which terminates at a cantilevered position over the swimming pool. A user engaging portion 10 is positioned at the cantilevered position of the aquatic exerciser 2 such that the user, generally shown in FIG. 2, can position himself adjacent the edge of the swimming pool and engage member 10 in carrying out various exercises. As can be seen in FIG. 2, the user can carry out such exercises as a chin-up where a portion of his body is raised above the water and the net force for carrying out this exercise is a function not only of the user's body weight, but the buoyancy force provided by the pool. As the proportion of the user's body within the pool varies during various phases of the exercise, the user can control, at least to some degree, the force which he desires. Thus, if he wishes to carry out a simpler exercise, he merely does not complete the full extent of the chin-up and thus, a larger portion of his body remains in the water.

The extension member 6 includes a generally 'U' shaped portion 8 which provides a dampening or spring like effect such that when a load is applied to the user engaging member 10, it is transmitted to the base via the spring or 'U' shaped portion 8 such that the shock load that must be carried by the base plate or mounting member 4 is reduced.

Figure 3:
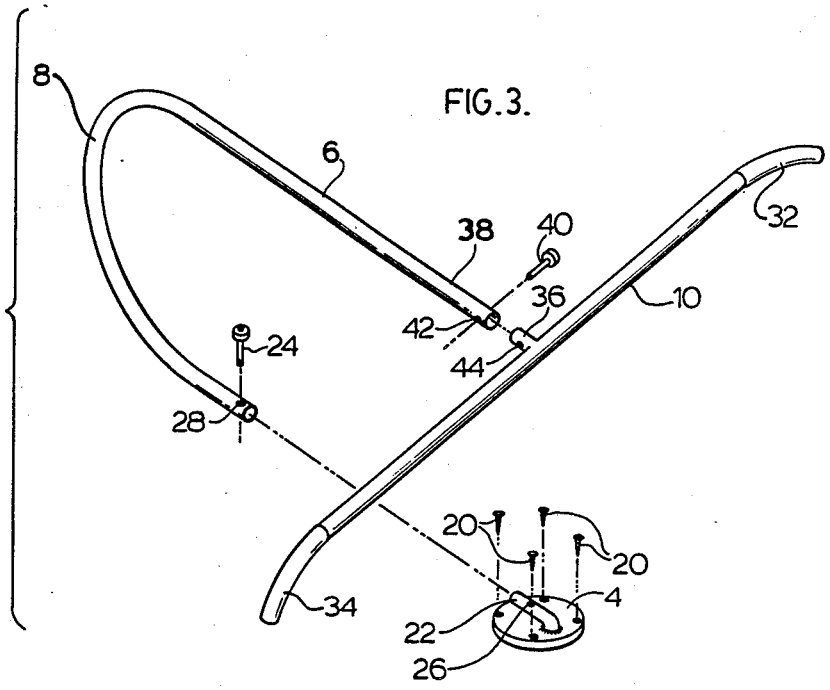
FIG. 3 is an exploded perspective view showing the cooperation of the base member of the extension member and the user engaging member.

As can be seen in FIG. 3, the mounting member 4 is secured adjacent the edge of the swimming pool 14 by means of screws 20 appropriately disposed in a support member of the pool. The mounting member 4 also includes a raised connection member 22 which is secured adjacent one edge of the mounting plate and extends across the mounting plate. The extension member 6 slides over this raised connection member 22 much in the manner of a male-female connection and the connection is maintained due to pin 24 passing through aperture 28 in the extension member 6 and lodging within aperture 26 of the raised connection member 22. At the opposite end of the connection member 6, the user engaging member 10, in this case in the form of a chin-up bar, is secured by means of the male connection portion 36 being inserted within the extension tube 6 which acts much in the manner of a female connection. The connection is maintained due to pin 40 passing through appropriate apertures 42 in the extension member 6 and through appropriate apertures 44 in the male connection 36.

Figure 1:
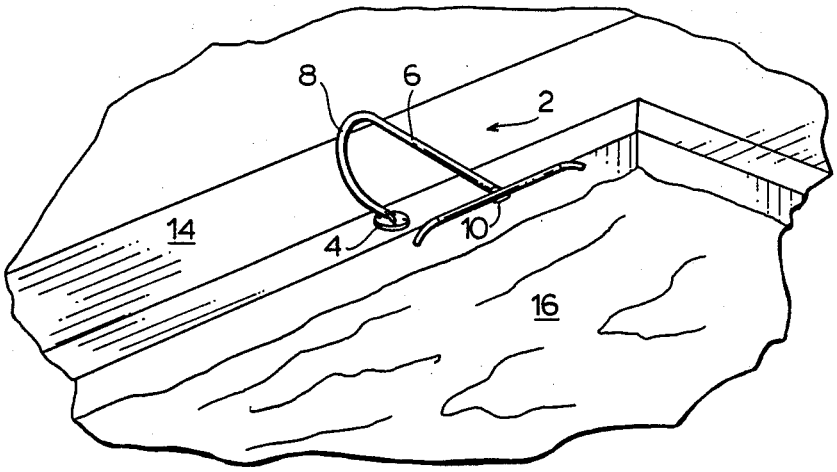
FIG. 1 is a partial perspective view showing the mounting arrangement secured at an edge of a swimming pool.
Figure 4:
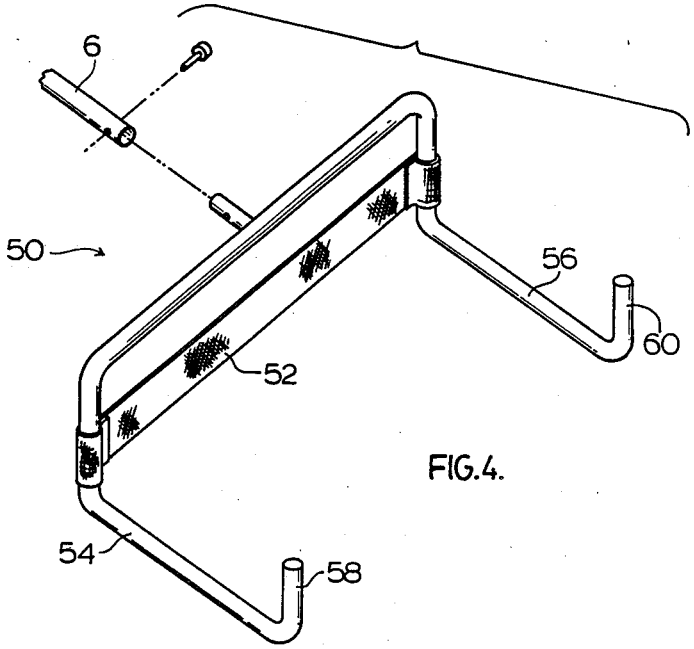
FIG. 4 is a partial perspective view of a different user engaging member and its cooperation with the extension member.
Figure 5:
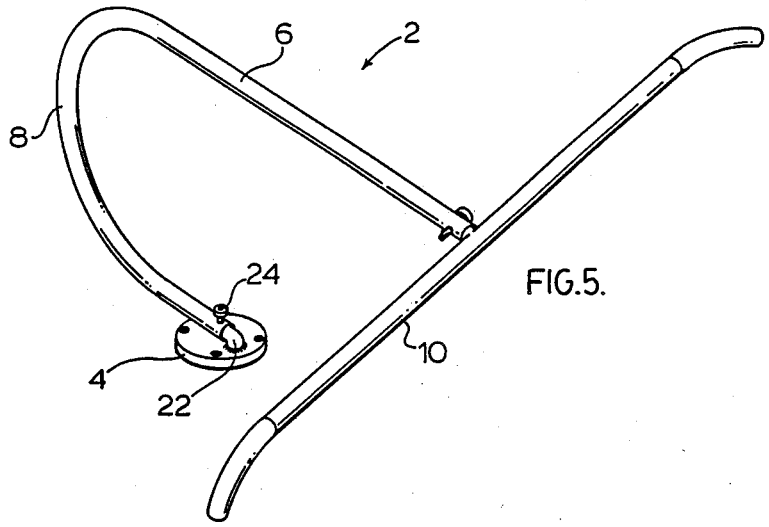
FIG. 5 is a perspective view of the aquatic exerciser.

Although the aquatic exerciser is shown in the drawings as primarily for use with the chin-up bar as the user engaging member 10, a different user engaging member is shown as 50 in FIG. 4. This particular user engaging member includes a back support 52 in combination with forearm supports 54 and 56 either side of the back support 54, with each of these forearm supports terminating in hand grips 58 and 60, respectively. The user would place his back against the back support 52 and his forearms rest on members 54 and 56, whereafter the user may carry out leg raises, as but one example. The leg raise user engaging portion 50 is basically in the form of a frame which is suspended below the cantilevered end of the extension member 6. In this way, the forearm supports 54 and 56 will be at the approximate water level of the pool, shown as 16 in FIG. 1, and the user may vary the strength required for carrying out the leg raises by merely selecting whether the legs have to be completely raised out of the water or whether a portion of the legs may remain in the water. As explained with respect to the chin-up exercise, the buoyancy force of the water within the pool allows the user to basically tailor the particular exercise to his degree of physical conditioning and his strength at that particular point in time. In the case of leg spreads and other exercises, the difficulty can be increased by having the legs within the water and increasing the speed of the exercise. This increases the drag force of the water, rendering the exercise more demanding.

The force which is exerted on the user engaging portion 10 is transmitted to the base plate via the extension member 6. The 'U' shaped configuration 8 reduces shock loads and allows a spring effect to occur between the base plate and the user engaging portion 10 whereby the force trying to separate the base plate 4 from the edge of the pool 14 is reduced.

Other arrangements for the aquatic exerciser are possible. In particular, the extension member 6 may be made of a flat plate and the base member 4 can be made in two sections with a channel between the two plates for receiving the flat plate. Suitable arrangements for pinning can also be provided. In this way, the base plate will distribute the load applied by the extension member 6 to a larger area and problems associated with the fracture of the connection portion 22 from the base plate are minimized. This structure also produces a generally flat plate adjacent the edge of the pool such that, when the extension member is removed, the danger associated with a projecting member is reduced. It is apparent other configurations are possible which would include socket arrangements provided adjacent the edge of the pool whereby removal of the exercise equipment or the extension member leaves the surface generally flush. The configuration shown for the mounting plate 4 has proven satisfactory, however, it is apparent that other arrangements are possible. Again, in the case of a flat bar type extension member 6 suitably bent to the configuration as shown in the drawings will act as a spring due to the 'U' shaped portion 8, and similar benefits result.

Figure 6:
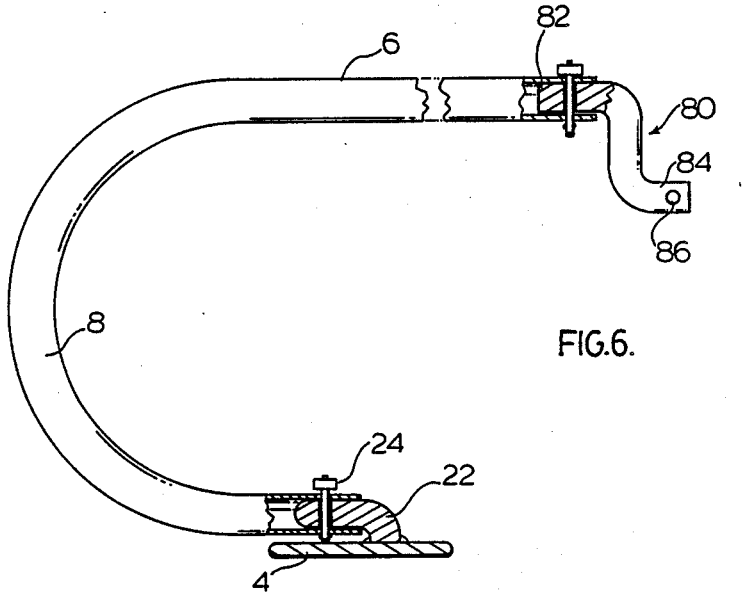
FIG. 6 is a sectional view showing the locking engagement of the various components of the aquatic exerciser including a height adjusting member.

In FIG. 6, a height adjusting member 80 is shown having a male portion 82 inserted within female connection 38 of extension member 6. Female end 84 of the height adjusting member 80 is sized to engage with any of the user engaging members 10 or 50 in the same manner as female connection 38. Apertures 86 are positioned for receiving a pin member to lock the user engaging member to the height adjusting member 80. The height adjusting member may be rotated 180° to provide an increase in height of the user engaging member.

Although the invention has been described with respect to exercises that are carried out within the pool in association with the chin-up bar shown in FIG. 3 and the leg raise structure of FIG. 4, other exercises are possible which can use this equipment. Similarly, other arrangements for locking of the user engaging portion to the extension member 6 and the locking of the extension member to the base plate can be provided. Details of the particular locking arrangement are shown in FIG. 6, where it can be seen that there is a substantial overlap of the male-female connection which has been pinned between the two components.

The exerciser has particular application for swimming pools, docks and rafts or other like structures which contain or have a satisfactory depth of water immediately adjacent thereto.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An exerciser comprising a mounting base having a base plate with a plurality of apertures therein by means of which said base plate is securable adjacent a support edge having a level of water in a forward direction, therebeyond;

an extension member having a lower arm extending rearwardly from said base, into a 'U' shaped section which curves upward and back over itself into an upper arm which extends cantilevered, over said lower arm in said forward direction, to a point beyond said base plate;

said 'U' shaped section of said extension member being located to one side of said mounting base with said upper arm having its free end terminating at a position located to the opposite side of said mounting base;

said upper arm supporting a user engaging member at its free end.

2. An exerciser as claimed in claim 1, wherein said user engaging member is detachable from said extension member and different user engaging members are provided to be attached to said extension member.

3. An exerciser as claimed in claim 1, wherein said mounting base includes a raised connection member adapted to cooperate with said extension member to effect a mechanical connection therebetween sufficient to fix the orientation of said extension member relative to said base plate, said connection member extending from said one edge in a direction generally across said base plate.

4. An exerciser as claimed in claim 3, wherein extension member slides over said connection member and is releasably pinned thereto and said user engaging portion has a male-female connection with said extension member to releasably secure said user engaging portion to said extension member in a predetermined orientation.

5. An exerciser as claimed in claim 4, wherein said user engaging portion in addition to said male-female connection includes means to oppose rotation of said male connection within said female connection.

6. An exerciser as claimed in claim 1, wherein said user engaging member is a chin-up bar centrally supported by said extension member.

7. An exerciser as claimed in claim 1, wherein said extension member is a tubular member releasably connected to said base member and said user engaging member.

8. An exerciser as claimed in claim 7, wherein said user engaging member is a chin-up type bar.

9. An exerciser as claimed in claim 1, wherein said user engaging member is releasably secured to said extension member and is replaceable with a different user engaging member, said user engaging member being in one form a chinup bar and in a different form a leg raise arrangement, said leg raise arrangement including a back support portion and two forearm support members extending outwardly either side of said back support portion and away from and below said extension member, whereby the level of said forearm support members is at the approximate level of the water within the pool.

* * * * *